US005927626A

United States Patent [19]

Shinjo et al.

[11] Patent Number: 5,927,626

[45] Date of Patent: Jul. 27, 1999

[54] SOLID SUBSTANCE CRUSHING VEHICLE

[75] Inventors: Hiroshi Shinjo, Okinawa Ken; Toyoyuki Okamoto, Yamaguchi Ken, both of Japan

[73] Assignees: Trim Co., Ltd., Okinawa ken; Toyo System Plants Co., Ltd., Yamaguchi ken, both of Japan

[21] Appl. No.: 08/915,588

[22] Filed: Aug. 21, 1997

[30] Foreign Application Priority Data

Dec. 27, 1996 [JP] Japan ..... 8-358107

[51] Int. Cl.[6] ..... B02C 21/02; B02C 23/08

[52] U.S. Cl. ..... 241/101.74; 241/101.741; 241/186.3; 241/186.35; 241/DIG. 38

[58] Field of Search ..... 241/101.74, 101.741, 241/101.742, 186.2, 186.3, 186.35, DIG. 38

[56] References Cited

U.S. PATENT DOCUMENTS

| | | | |
|---|---|---|---|
| 4,254,874 | 3/1981 | Arnoldsson et al. | 241/101.7 X |
| 4,763,846 | 8/1988 | High, Jr. et al. | 241/81 |
| 4,786,003 | 11/1988 | Johnson | 241/101.7 |
| 5,186,397 | 2/1993 | Orlando | 241/23 |
| 5,226,757 | 7/1993 | Tarrant | 241/101.7 X |
| 5,423,492 | 6/1995 | Willis | 241/81 |
| 5,457,271 | 10/1995 | Aulson | 241/DIG. 38 X |
| 5,520,343 | 5/1996 | Aika et al. | 241/99 |

*Primary Examiner*—John M. Husar

*Attorney, Agent, or Firm*—Sughrue, Mion, Zinn, Macpeak & Seas, PLLC

[57] ABSTRACT

The present invention relates to a solid substance crushing vehicle which is able to move to a place of collection of glass products, chinaware, old stools, bricks, refractories, tourmaline of magnetic ores, etc. to automatically crush, produce, screen the crushed substances and cutlets at a high operational efficiency by only switching on after such solid substances are charged through its charging opening, wherein the same is constructed so as to include a crushing machine 4 installed on the deck 3 of a vehicle 2, a charging unit 5 connected to the crushing machine 4, a crushed substance transfer device 6, one end of which is connected downward of the crushing machine 4, a screening portion 7, one end of which is connected to the crushed substance transfer device 6, collecting cases 11*a*, 11*b*, 11*c* connected to the other end of the screening portion 7, a cover portion 15 to cover up the respective devices, and an elevating unit 16 openably and closably disposed at the opening 15*b* of the cover portion 15.

10 Claims, 5 Drawing Sheets

SOLID SUBSTANCE CRUSHING VEHICLE

BACKGROUND OF THE INVENTION

1. Field of the Invention

The present invention relates to a solid substance crushing vehicle which is able to move to various places such as an incombustible substance collecting place, sightseeing places, etc. and is able to break and crush solid substances such as glass products, chinaware, bricks, etc.

2. Description of the Prior Art

Recently, treatment of incombustible solid substances has been a problem due to an increase of glass products and products made of chinaware, bricks, etc.

Conventionally, after solid substances such as glass products, chinaware, bricks, etc. were gathered at a predetermined place, a collecting truck collected the solid substances and conveyed the same to a treatment facility of incombustibles, where they were broken, crushed and screened.

Furthermore, with respect to glass products such as glass bottles, some may be re-used as they are, and the rest are broken and crushed to be cullets of glass waste. The cullets are classified according to colors and foreign substances are eliminated therefrom. Thereafter the cullets are heated and melted, and they are re-used as the material for glass bottles.

However, on islands or sightseeing at places, etc., a great deal of time and cost are required to convey incombustibles to a treatment facility, since only a small number of collection times by the collecting truck may be available. Accordingly a problem arises where the treatment capacity of solid substances such as glass products, chinaware, bricks, etc. does not catch up with the quantity of discharged solid substances.

Therefore, a transportable type glass crushing system is available which can move to any optional place and is able to break and crush solid substances such as glass products like glass bottles, chinaware, bricks, etc., comprising, on the truck deck, etc., a glass crushing machine, a bucket type charging conveyor for charging glass products such as glass bottles into charging a port of the glass crushing machine, a screw type transfer conveyor connected to the lower part of the glass crushing machine and used for conveying crushed substances, a grain size selector connected to the transfer conveyor and used for screening crushed substances according to the grain sizes, and a suction type dust collector connected to the glass crushing machine.

However, the abovementioned conventional glass crushing system has the following shortcomings and problems.

A problem arises, where when charging solid substances such as glass products into a glass crushing machine, it is necessary to unload a charging conveyor from a deck of a vehicle such as a truck with a bucket of a bucket type charging conveyor, which is used for charging solid substances, matched to the charging opening of a glass crushing machine. Accordingly the working efficiency of charging the solid substances is made insufficient, and some working space to unload the charging conveyor is required.

Since a screw type transfer conveyor which transfers crushed substances via a crushed substance collecting portion having an inclined side wall, is connected to the lower part of a glass crushing machine, a scraper for collecting crushed substances is provided at the crushed substance collecting portion in order to cause the crushed substances to fall onto the transfer conveyor, and a vibrator for vibrating the side walls of the crushed substance collecting portion is disposed at the crushed substance collecting portion. However, a problem arises where the structure thereof is very complicated, and the maintenance thereof is not easy. Furthermore, since the transfer conveyor is constructed to be screw-like, the crushed substances may fall down through the clearance portions, and the transfer performance is not good.

Furthermore, since crushed substances transferred by a screw-type transfer conveyor are collected at one place, there are problems, that is, it is necessary to replace crushed substance collecting cases in a case where the the grain size of the crushed substance is changed, and a lift or the like is required when unloading the collecting cases from the deck of a vehicle such as a truck.

Still furthermore, in a case where glass products such as glass bottles, etc. are crushed, it is impossible to classify them according to the colors. Therefore, if the crushed substances are re-used as cullets, plenty of time and manpower are required to classify the crushed substances according to the colors. Therefore, the working efficiency is very bad.

SUMMARY OF THE INVENTION

The present invention was developed to solve the abovementioned conventional problems, and it is therefore, an object of the invention to provide a solid substance crushing vehicle which is able to move to a place of collecting incombustibles such as glass products, chinaware, old stools, bricks, refractories, tourmaline of magnetic ores, etc. and is able to automatically crush the solid substances, to produce cullets and to screen to collect by only charging the solid substances into a charging machine through a charging opening at the place of collection and switching on the machine, wherein the working efficiency is excellent. Further it is possible for the solid substance collecting vehicle to move to any optional place like a conventional dust collecting vehicle, to collect and crush solid substances.

In order to solve the above problems, a solid substance crushing vehicle according to the invention is provided with a vehicle such as a truck, a crushing machine installed on the deck of the vehicle, a charging unit for charging solid substances such as glass products, chinaware, etc., into the crushing machine, a crushed substance transfer device linked to the crushing machine and used for transferring the crushed substances, a screening portion linked to the crushed substance transfer device, and one or a plurality of collecting cases disposed at the discharge side of the screening portion.

With this construction, the solid substance crushing vehicle is able to move to an incombustible collecting place and any optional place such as islands, sightseeing places, to collect solid substances such as glass products, chinaware, bricks, etc. at various places, to crush the solid substances, and to produce cullets.

Furthermore, after charged solid substances are conveyed to a crushing machine and are crushed by the crushing machine by only charging solid substances into a charging unit, the crushed substances are collected into collecting cases by a crushed substance transfer device via a screening portion, wherein the solid substances are automatically crushed, cullets are automatically produced therefrom, and the collection thereof is enabled.

Furthermore, since the vehicle is provided with a plurality of collecting cases and a screening portion, it is possible to classify and collect the crushed substances and cullets according to the colors and kinds of solid substances, whereby the efficiency of treatment work of the solid substances can be improved.

As described later, a solid substance crushing vehicle according to the invention, includes the following excellent advantages and effects.

(1) Since a crushing machine, a charging unit, a crushed substance transfer device, a screening portion, collecting cases, etc. are installed on the deck of a vehicle, the entire system is able to move to an incombustible gathering place and any optional place such as islands, sightseeing places, and is able to collect and crush solid substances such as glass products, chinaware, old stools, bricks, refractories, tourmaline of magnetic ores,etc. and to produce cullets therefrom. Therefore, the treatment efficiency of solid substances is excellent, and the convenience thereof is improved.

(2) By only charging solid substances such as glass products, chinaware, old stools, bricks, refractories, tourmaline of magnetic ores, etc. into the charging unit through the charging opening of the cover portion and switching on the system, it is possible to automatically crush the solid substances and to produce cullets as in a conventional dust collecting vehicle, and the treatment of solid substances can be efficiently performed in safety in a short time.

(3) Solid substances such as glass products, chinaware, old stools, bricks, refractories, tourmaline of magnetic ores, etc. can be crushed color by color and kind by kind, and the screening portions can be changed over according to the colors and kinds thereof and the collecting cases can be changed according to the respective kinds and colors of crushed substances and cullets. Therefore, it is possible to produce and collect the crushed substances and cullets while classifying the same in compliance with the colors and kinds. As a result, the post-treatment of the crushed substances and cullets can be easily performed in a short time, thereby improving the working efficiency. Furthermore, as cullets can be collected color by color, the classification of cullets for re-use is not required anymore, and the efficiency of re-use can be improved.

(4) Since the cover portion is provided on the deck of a vehicle to cover the respective devices, it is possible to protect the respective devices from rain, wind, etc. and to prevent foreign substances from entering. Since the respective devices are not exposed, it is possible to secure the safety of workers and surroundings while crushing solid substances.

(5) Since the crushing machine is provided with a scraper connected to the drive shaft and a crushing roller, it is possible to evenly crush solid substances such as glass products, chinaware, old stools, bricks, refractories, tourmaline of magnetic ores, etc. charged into the crushing chamber while spreading them in the crushing chamber without accumulating them at one place. Therefore, it is possible to efficiently crush solid substances in a short time.

(6) Since the crushing machine is provided with a detachable porous bottom plate, it is possible to replace the same for other porous bottom plates having different pore diameters, whereby it is possible to change the grain size of crushed substances and cullets, and cullets of various kinds of grain sizes can be produced.

(7) A dust collector is connected to the crushing machine and/or collecting cases, and it is possible to prevent dust and dirt from being scattered in the cover portion on the deck on which the respective devices are installed and to prevent the drive means of the respective devices from malfunctioning due to dust and dirt. Therefore, the durability of the respective devices can be improved.

(8) By providing an inclination plate and a charging unit consisting of a charging case having a discharge port open to the inclination plate side, solid substances such as glass products, chinaware, old stools, bricks, refractories, tourmaline of magnetic ores, etc. can be transferred to the crushing machine by only charging the same into a charging case. It is also possible to charge solid substances without reversing the charging case, whereby the construction of the charging unit can be simplified, and the charging can be efficiently carried out.

(9) By providing a charging unit drive means having a block, a cylinder and a wire, the charging unit drive means can be made small-sized, and simultaneously the cylinder can be installed at any optional place, depending on the installation place of the block. Therefore, the limited space on the deck can be effectively utilized, and the solid substance crushing vehicle can be made very compact.

(10) By providing a screening portion having a damper and a damper changeover means, the dampers can be changed over when charging solid substances such as glass products, chinaware, old stools, bricks, refractories, tourmaline of magnetic ores, etc. and the crushed substances and cutlets can be collected color by color and kind by kind, specifying the collecting cases according to the colors and kinds of solid substances. Therefore, it is possible to produce and screen crushed substances and cullets, wherein the post-treatment of the crushed substances and cullets can be facilitated, and the working efficiency is further improved.

(11) Since a crushed substance transfer device consisting of a belt conveyor having a transfer belt equipped with drop preventing means is employed, it is possible to securely transfer cullets without their falling, and the transfer treatment of the cullets is excellent.

(12) Since an elevating unit having an openable and closable disposed lift portion is employed, it is possible to compactly accommodate the elevating unit without requiring any wide accommodation space when the same is not used, whereby the solid substance crushing vehicle can be prevented from being made large-sized, and it is possible to carry in and out the collecting cases with the same placed on the lift portion, when carrying in the collecting cases and carrying out the crushed substances and cullets. That is, the working efficiency is further improved.

(13) Since collecting cases having wheels, rolling on rails, on the bottom thereof, are employed, it is possible to move the collecting cases along the rails when carrying in and out the collecting cases, to save manpower when carrying in and out the collecting cases. That is, the working efficiency is further improved.

(14) Since an oil hydraulic drive means is provided for the respective devices installed on a deck, no large-sized power supply source is required, and the respective devices can be driven by utilizing the engine of a vehicle, whereby it is possible to prevent the solid substance crushing vehicle from becoming large-sized.

BRIEF DESCRIPTION OF THE DRAWING

The above and other advantages of the invention will become more apparent from the following description taken in conjunction with the accompanying drawings wherein like reference numerals refer to like parts and wherein.

DESCRIPTION OF THE PREFERRED EMBODIMENT

Figure 1:
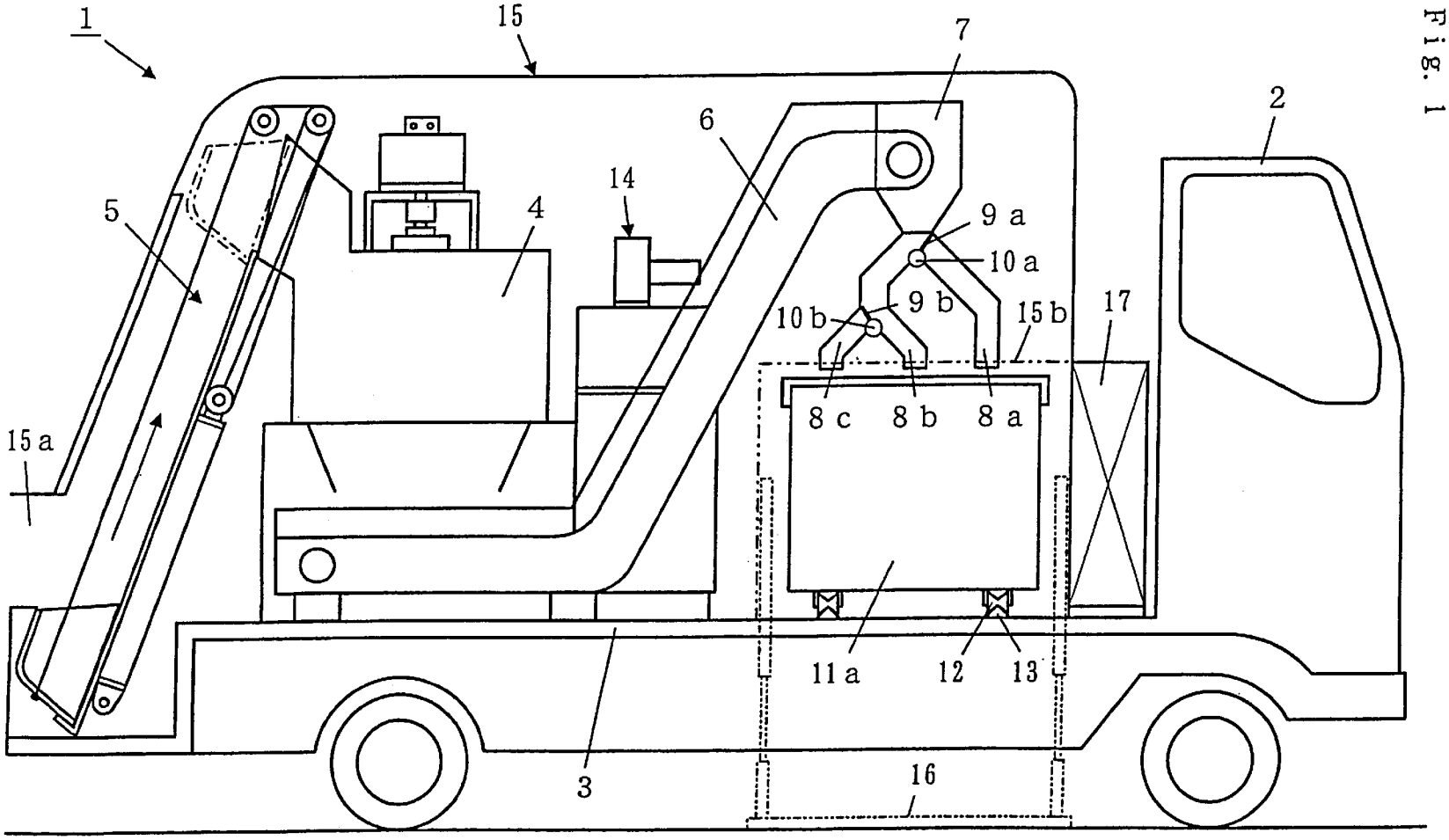
FIG. 1 is a side elevational view of major parts of a solid substance crushing vehicle according to a preferred embodiment.

A solid substance crushing vehicle according to the invention is constructed to comprise a vehicle such as a truck, etc. a crushing machine installed on a deck of the vehicle; a charging unit for charging solid substances such as glass products, ceramics, etc. into the crushing machine; a crushed substance transfer device linked to the crushing machine and used for transferring the crushed substances; a screening portion linked to the crushed substance transfer device; and one or a plurality of collecting cases disposed at the discharge side of the screening portion.

Thereby, the vehicle has such actions by which, moving to any optional place, solid substances such as glass products, chinaware, bricks, etc. are collected, crushed, and cullets are produced therefrom.

By only switching on after solid substances are charged into a charging unit, the charged solid substances are conveyed to a crushing machine and crushed therein, the substances and cullets thus crushed and produced are collected into collecting cases via a screening portion by a crushed substance transfer device. That is, it is possible to automatically crush solid substances, to produce, screen and collect cullets.

Furthermore, by arranging a plurality of collecting cases via a screening portion, it is possible to collect crushed substances and cullets color by color and kind by kind.

A solid substance crushing vehicle according to the invention is further constructed so that the same comprises an elevating unit for elevating and lowering the collecting cases, a cover portion, which is installed upward of the deck, for covering the crushing machine, the charging unit, the crushed substance transfer device, the screening portion, and the collecting cases, a charging opening portion formed at the cover portion in order to charge solid substances, and an opening formed at the side of said collecting cases of said cover portion.

Thereby, since the solid substance crushing vehicle is provided with an elevating unit for elevating and lowering the collecting cases, it is possible to carry in and out the collecting cases by the elevating unit, and especially, it is easy to take out crushed substances and cullets collected in the collecting cases.

Furthermore, a cover portion is disposed above the deck, each of the devices and units can be protected and not exposed on the deck of a vehicle. Therefore, it is possible to secure the safety while each of the units and machine is operating.

Herein, in a case where an openable and closable door portion is disposed at the charging opening formed at the cover portion, it is possible to prevent foreign substances from entering through the charging opening when the solid substance crushing vehicle runs or the vehicle is not used.

Still furthermore, in a case where an openable and closable entrance is provided at the cover portion, a maintenance person can easily enter inside the cover portion for maintenance, etc.

Furthermore, an openable and closable shutter may be used as a door portion attached to the charging opening. And although the door portion may be closed or opened during the operation of a crushing machine, it is preferable that the door portion is closed at the standpoint of safety.

A solid substance crushing vehicle according to the invention is constructed so that the crushing machine is provided with a cylindrical crushing chamber, a drive shaft located in the same direction as the axial direction of the crushing chamber disposed at a roughly middle portion of the crushing chamber, a crushing machine drive means connected to the drive shaft and disposed on the upper surface of a ceiling portion of the crushing chamber, a crushed substance collecting portion disposed downward of the crushing chamber, a porous bottom plate detachably disposed between the crushing chamber and the crushed substance collecting portion and provided with a number of pores, a rotatable crushing roller connected to the drive shaft via a connection means, a crushing element consisting of a number of square columnar rows formed on the outer circumferential face of the crushing roller, and a scraper connected to the drive shaft via a connection means.

Thereby, solid substances such as glass products, chinaware, bricks, etc. charged into a crushing machine can be crushed to the size roughly equivalent to the pores formed on the porous bottom plate and fall onto the crushed substance collecting portion, wherein crushed substances and cullets can be produced. Furthermore, the charged solid substances can be spread in the crushing chamber by a scraper connected to the drive shaft without accumulating the charged solid substances at one place, wherein the solid substances can be evenly crushed.

Still furthermore, by replacing the porous bottom plate for another porous bottom plate having a different pore diameter, it is possible to change the grain size of crushed substances and cullets.

Herein, in a case of a large-sized crushing machine or in a case where a great deal of solid substances are charged, a crushing roller may be linked to the drive shaft instead of a scraper, whereby the crushing efficiency can be improved.

A solid substance crushing vehicle according to the invention is constructed so that the same comprises a dust collecting machine connected to the crushing machine and/or the collecting cases and installed on the deck.

Thereby, it is possible to prevent dust and dirt from being splashed in the surrounding when charging solid substances such as glass products, chinaware, bricks, etc. are charged, or collecting crushed substances and/or cullets, and it is possible to carry out a crushing treatment and to produce cullets without splashing dust and dirt, etc. on the deck of a vehicle, which is covered by the cover portion. Still furthermore, it is possible to prevent the drive portion, etc. of the crushing machine from malfunctioning due to dust and dirt.

A solid substance crushing vehicle according to the invention is constructed so that the charging unit is provided with an inclination plate, a charging case which vertically moves along the inclination plate, a discharge port open to the inclination plate side of the charging case, and a charging unit drive means for vertically moving the charging case.

Thereby, by only charging solid substances such as glass products, chinaware, bricks, etc. into a charging case and vertically moving the charging case, it is possible to charge the solid substances into a crushing machine. Furthermore, since a discharge port is made open to the inclination plate side of the charging case, the solid substances can be charged into the crushing machine through the discharge port without reversing the charging case.

Still furthermore, an inclination conveyor, etc. having crosspieces at appointed positions of a transfer belt may be used as a charging unit. Solid substances can be continuously charged into the crushing machine.

A solid substance crushing vehicle according to the invention is constructed so that the charging unit drive means is provided with a block disposed at an appointed position, a cylinder for vertically moving the charging case, and a wire for connecting the charging case and the cylinder to each other via the block.

Thereby, since the cylinder is linked to the charging case by a wire via a block, it is possible to make the charging unit drive means small-sized, and since the block is disposed at an appointed position, it is possible to change the arrangement position of the cylinder and the deck of a vehicle can be effectively utilized.

A solid substance crushing machine according to the invention is constructed so that the screening portion is provided with a crushed substance passage portion installed at and communicating with the crushed substance transfer device, a damper disposed at the crushed substance passage portion, and a means for changing the damper.

Thereby, by crushing solid substances such as glass products, chinaware, bricks, etc. color by color and kind by kind by changing the damager, it is possible to collect crushed substances and cullets into each of the collecting case while screening the same color by color and kind by kind.

Furthermore, an oil hydraulic type, electromagnetic type, pneumatic type, etc. may be used as a changing means of the damper.

A solid substance crushing vehicle according to the invention is constructed so that the crushed substance transfer device consists of a belt conveyor which is disposed downward of the crushing machine and is provided with a transfer belt having a drop preventing portion erect from the side portions and at appointed portions in the lengthwise direction thereof.

Thereby, crushed substances and cullets produced by the crushing machine fall onto the transfer belt, and the crushed substances and cullets are continuously transferred onto the screening portion by the belt conveyor. Furthermore, since the transfer belt is provided with drop preventing portions, it is possible to prevent the crushed substances and cullets from dropping from the transfer belt when they are caused to fall down thereon and when the same are transferred.

A solid substance crushing vehicle according to the invention is constructed so that the elevating unit is provided with a lift portion having a rail portion on the upper surface of a flat plane portion, at which the flat plane portion is disposed so as to be openable and closable, and an elevating unit drive means for vertically moving said lift portion.

Thereby, by causing the collecting cases to move onto the upper surface of the flat plane portion along the rail portion with the lift portion opened and vertically moving the lift portion, it is possible to carry in and out the collecting cases. Furthermore, since the flat plane portion is openably and closably disposed, it is possible to accommodate the lift portion at the side of the solid substance crushing vehicle when the elevating unit is not used. Accordingly, it is possible to prevent the solid substance crushing vehicle from being made large-sized.

Herein, an oil hydraulic, etc. cylinder and motor, or electric, pneumatic cylinders and motors, etc. may be used as an elevating unit drive means.

A solid substance crushing vehicle according to the invention is further constructed so as to comprise a rail disposed downward of the collecting cases and a wheel disposed on the bottom face of said collecting cases and rolling on the rail.

Thereby, it is possible to cause the collecting cases to move along the rail when carrying in and out the collecting cases. In particular, it is possible to save manpower in a carry-out work of cullets collected in the collecting cases.

Herein, it is preferable that wheels provided with stoppers are disposed on the bottom face of the collecting cases. It is possible to prevent the collecting cases from moving while the solid substance crushing vehicle is running or during the crushing. Furthermore, adjusters may be provided on the bottom face of the collecting cases. While the vehicle is running or during the crushing, the adjusters are adjusted to raise the wheels from the rail, wherein the collecting cases are prevented from moving.

A solid substance crushing vehicle according to the invention is constructed so that at least the crushing machine, the charging unit, the crushed substance transfer device, the screening portion and the elevating unit are provided with an oil hydraulic drive means.

Thereby, with no large-sized power supply source installed on the deck of the vehicle, the respective devices can be driven by utilizing the engine of the vehicle, whereby it is possible to prevent the solid substance crushing vehicle from being made large-sized.

Hereinafter, a description will be given of a solid substance crushing vehicle according to a preferred embodiment with reference to the accompanying drawings.

Figure 2:
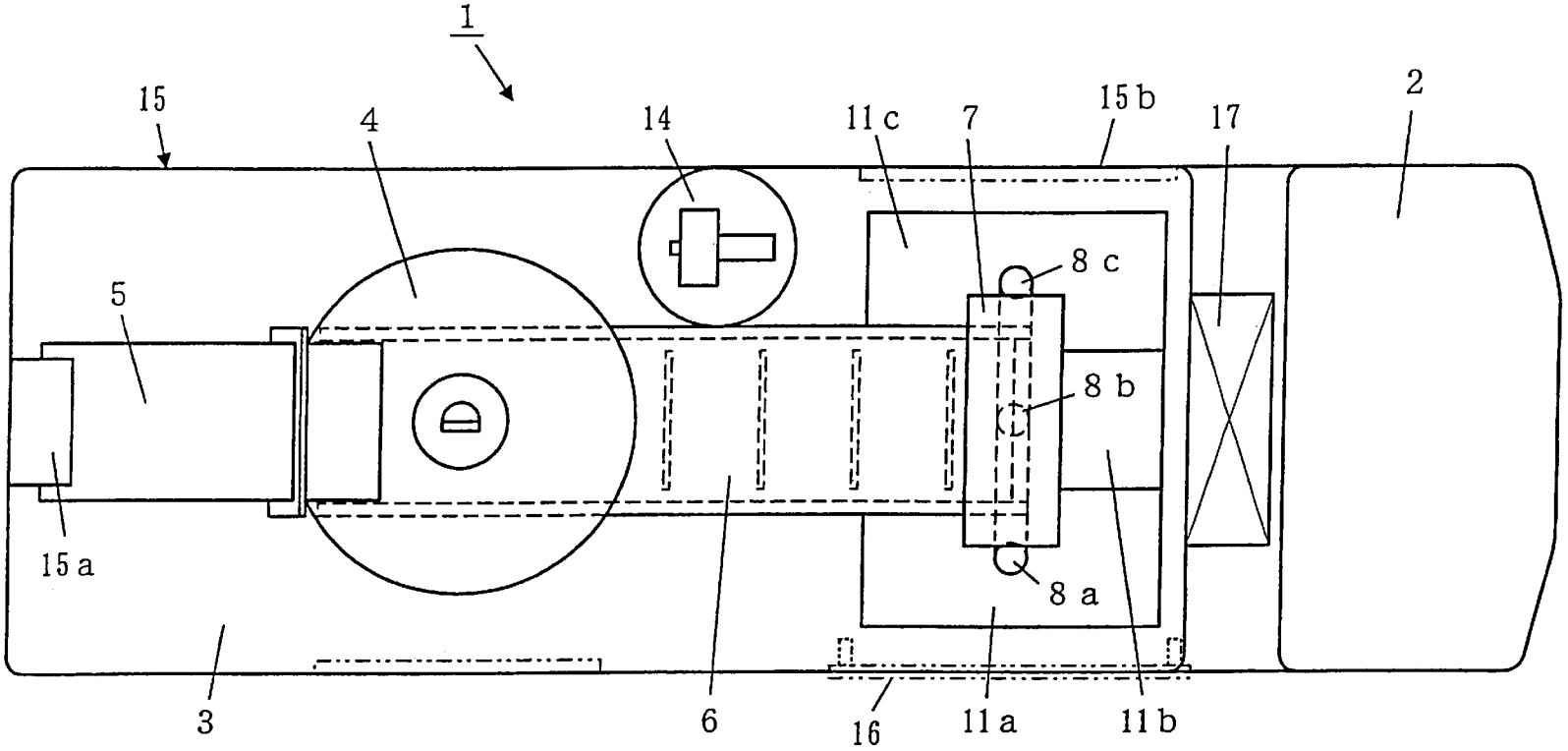
FIG. 2 is a cross-sectional plan view of major parts of a solid substance crushing vehicle according to the preferred embodiment.
Figure 3:
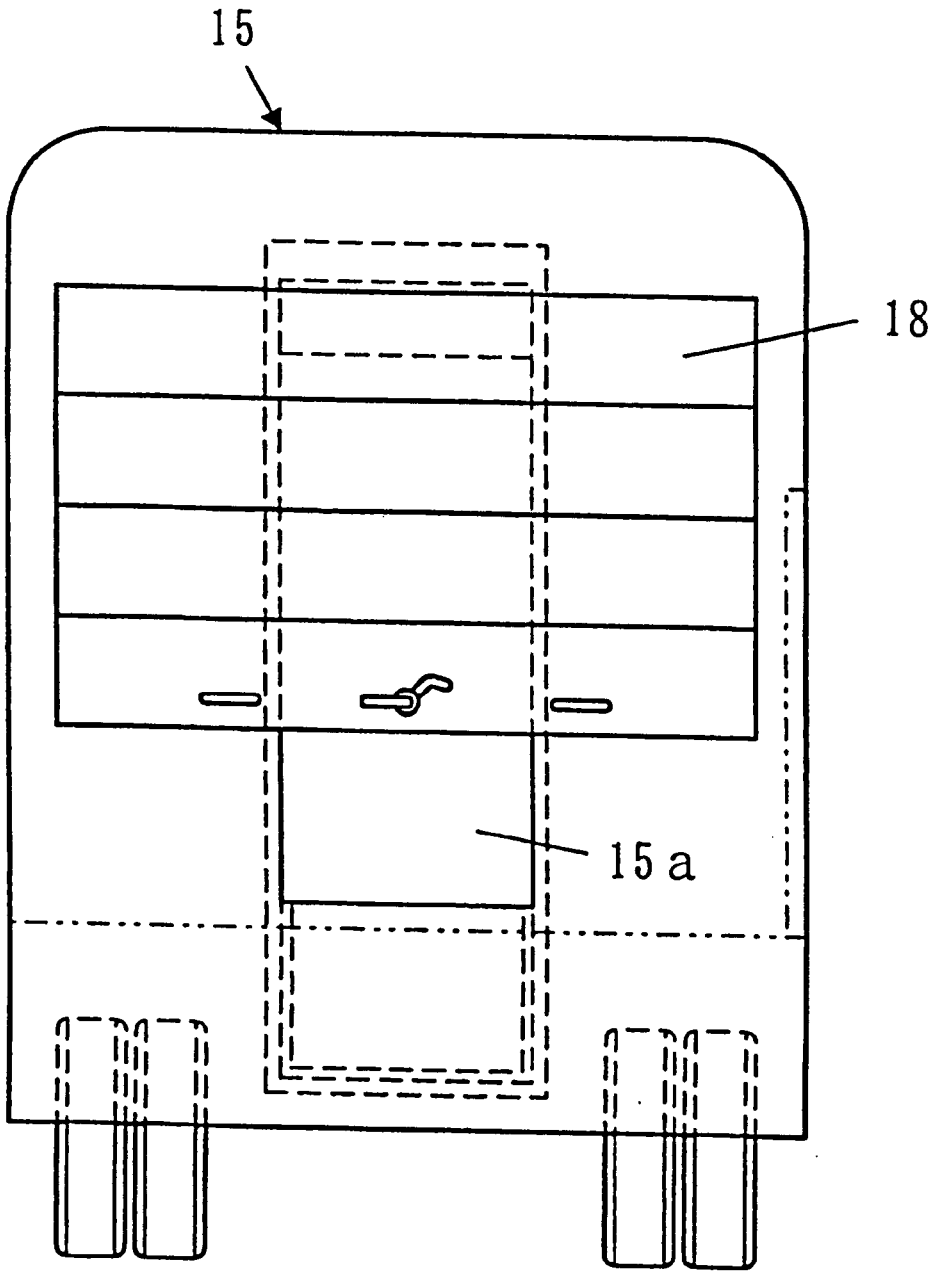
FIG. 3 is a back side view of major parts of a solid substance crushing vehicle according to the preferred embodiment.

FIG. 1 is a side elevational view of major parts of a solid substance crushing vehicle according to the preferred embodiment, FIG. 2 is a cross-sectional plan view of major parts of a solid substance crushing vehicle according to the preferred embodiment, and FIG. 3 is a rear side view of major parts of a solid substance crushing vehicle according to the preferred embodiment.

In these drawings, 1 is a solid substance crushing vehicle according to the preferred embodiment, 2 is a vehicle of the solid substance crushing vehicle 1, 3 is a deck of the vehicle 2, 4 is a crushing machine which is installed at the rearward side of the deck 3 and is able to crush solid substances such as glass products, chinaware, bricks, etc. 5 is a charging unit installed at and communicating with the crushing machine 4 and installed rearward of the deck 3. 6 is a crushed substance transfer device installed on the deck 3 with one end thereof communicating with the base of the crushing machine 4, 7 is a screening portion with one end thereof communicating with the other end of the crushed substance transfer device 6. 8*a*, 8*b*, and 8*c* are crushed substance paths of the screening portion 7. 9*a* and 9*b* are dampers disposed in the crushed substance paths 8*a*, 8*b* and 8*c*. 10*a* and 10*b* are changeover portions of the dampers 9*a* and 9*b*. 11*a*, 11*b* and 11*c* are collecting cases each installed at and communicating with the crushed substance paths 8*a*, 8*b* and 8*c* of the screening portion 7 and installed on the deck 3. 12 is a stopper-attached wheel disposed on the bottom face of the collecting cases 11*a*, 11*b* and 11*c*. 13 is a rail installed on the deck 3, on which the wheel 12 rolls. 14 is a dust collector which is connected to the crushing machine 4 and the collecting cases 11*a*, 11*b* and 11*c* and is installed on the deck 3. 15 is a cover portion disposed upward of the deck 3, which is able to cover the crushing machine 4, charging unit 5, crushed substance transfer device 6, screening portion 7, collecting cases 11*a*, 11*b* and 11*c*, and dust collecting machine 14. 15*a* is a charging opening formed downward of the rearward of the vehicle 2 of the cover portion 15. 15*b* is an opening formed at the cover portion 15 at the side of the collecting cases 11*a* and 11*c*. 16 is an elevating unit openably and closably disposed at the opening of 15*b* of the cover portion 15. 17 is an oil hydraulic tank installed forward of the deck 3. 18 is a shutter type door portion which opens and closes the charging opening 15*a*.

A description will be given of the actions of a solid substance crushing vehicle constructed as described above.

The shutter type door portion 18 is opened, and solid substances such as glass products, chinaware, old stools, bricks, refractories, tourmaline of magnetic ores, etc. are charged into a charging unit 5 through the charging opening 15*a*, wherein the charged solid substances are transferred to the crushing machine 4 by the charging unit 5 and charged in the crushing machine 4.

Next, the charged solid substances are crushed by the crushing machine 4, and the crushed substances and cullets are produced. The crushed substances and cullets produced by the crushing machine 4 fall onto the crushed substance transfer device 6 communicating with the base of the crushing machine 4 and are transferred to the screening portion 7 by the crushed substance transfer device 6. Furthermore, the crushed substances and cullets passed through the screening portion 7 fall onto any one of the collecting cases 11*a*, 11*b* and 11*c* for collection.

The elevating unit 16 is opened after the crushed substances and cullets are produced and collected, wherein the collecting cases 11*a*, 11*b* and 11*c* into which the crushed substances and cullets are collected are placed on the elevating unit 16 one after another from the opening 15*b* of the cover portion 15 and are unloaded from the deck 3 of the vehicle 2, wherein the crushed substances and cullets are discharged from the collecting cases 11*a*, 11*b* and 11*c*.

Next, a description will be given of the crushing machine according to the preferred embodiment with reference to the accompanying drawings.

Figure 4:
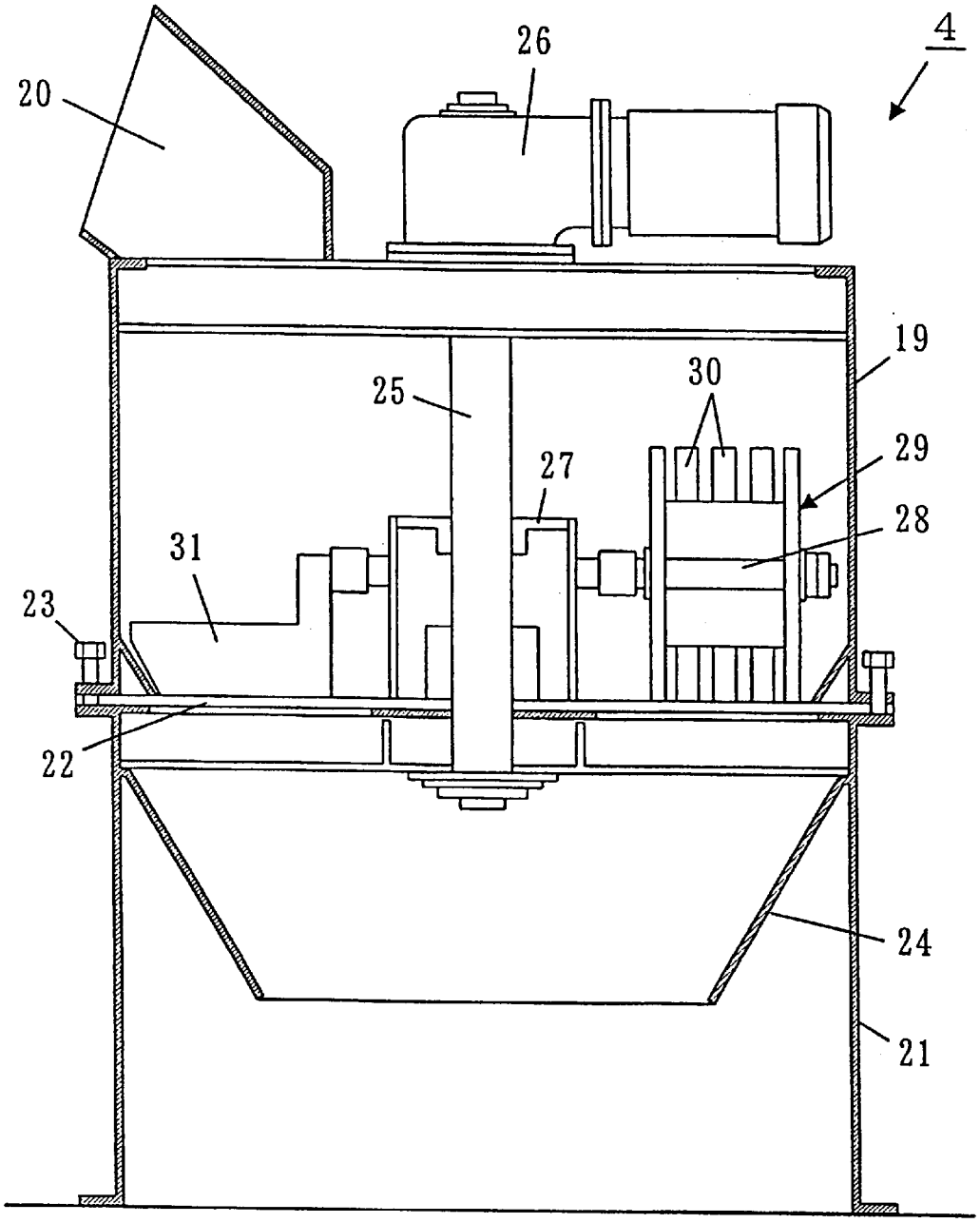
FIG. 4 is a cross-sectional side view of major parts of a crushing machine of the solid substance crushing vehicle according to the preferred embodiment.

FIG. 4 is a cross-sectional side view of major parts of a crushing machine of a solid substance crushing vehicle according to the preferred embodiment.

In the drawing, 19 is a cylindrical crushing chamber of the crushing machine 4, 20 is a crushing chamber charging port open to the ceiling face of the crushing chamber 19. 21 is a collecting chamber, the shape of which is identical to that of the crushing chamber 19 disposed downward of the crushing chamber 19. 22 is a porous bottom plate detachably disposed between the crushing chamber 19 and the collecting chamber 21 and having a number of pores. 23 is a clearance adjusting bolt for adjusting the clearance between the crushing chamber 19 and the collecting chamber 21 when detaching and attaching the porous bottom plate 22. 24 is a crushed substance collecting portion, the lower end of which is open, disposed downward of the crushing chamber 19 via the porous bottom plate 22. 25 is a drive shaft located in the same direction as the axial direction of the crushing chamber 19. 26 is a crushing machine drive means connected to the drive shaft 25 and consisting of an oil hydraulic motor disposed on the upper surface of the ceiling portion of the crushing chamber 19. 27 is a linkage means connected to the drive shaft 25. 28 is a roller shaft which rotates centering around the drive shaft 25 in line with rotations of the drive shaft 25 and is supported by the linkage means 27. 29 is a crushing roller pivotally supported at the roller shaft 28 so as to be rotatable. 30 is a crushing element, formed on the outer circumference of the crushing roller 29, consisting of a number of square columnar rows. 31 is a scraper linked to the linkage means 27 rotatably centering around the drive shaft 25.

A description will be given of the actions of the crushing machine constructed as described above.

Solid substances such as glass products, chinaware, old stools, bricks, refractories, tourmaline of magnetic ores, etc. charged in the crushing chamber 19 through the crushing chamber charging port 20 are gathered near the travelling portion side of the crushing roller 29 by the scraper 31 in line with rotations of the drive shaft 25, and at the same time they are crushed by the crushing elements 30 formed on the outer circumferential surface of the crushing roller 29 which rotates in the crushing chamber 19 centering around the drive shaft 25. The crushed substances and cullets crushed and produced by the crushing roller 29, pass through the pores of the porous bottom plate 22 and are fall onto the crushed substance collecting portion 24.

Next, a charging unit according to the preferred embodiment will be described, using the accompanying drawing.

Figure 5:
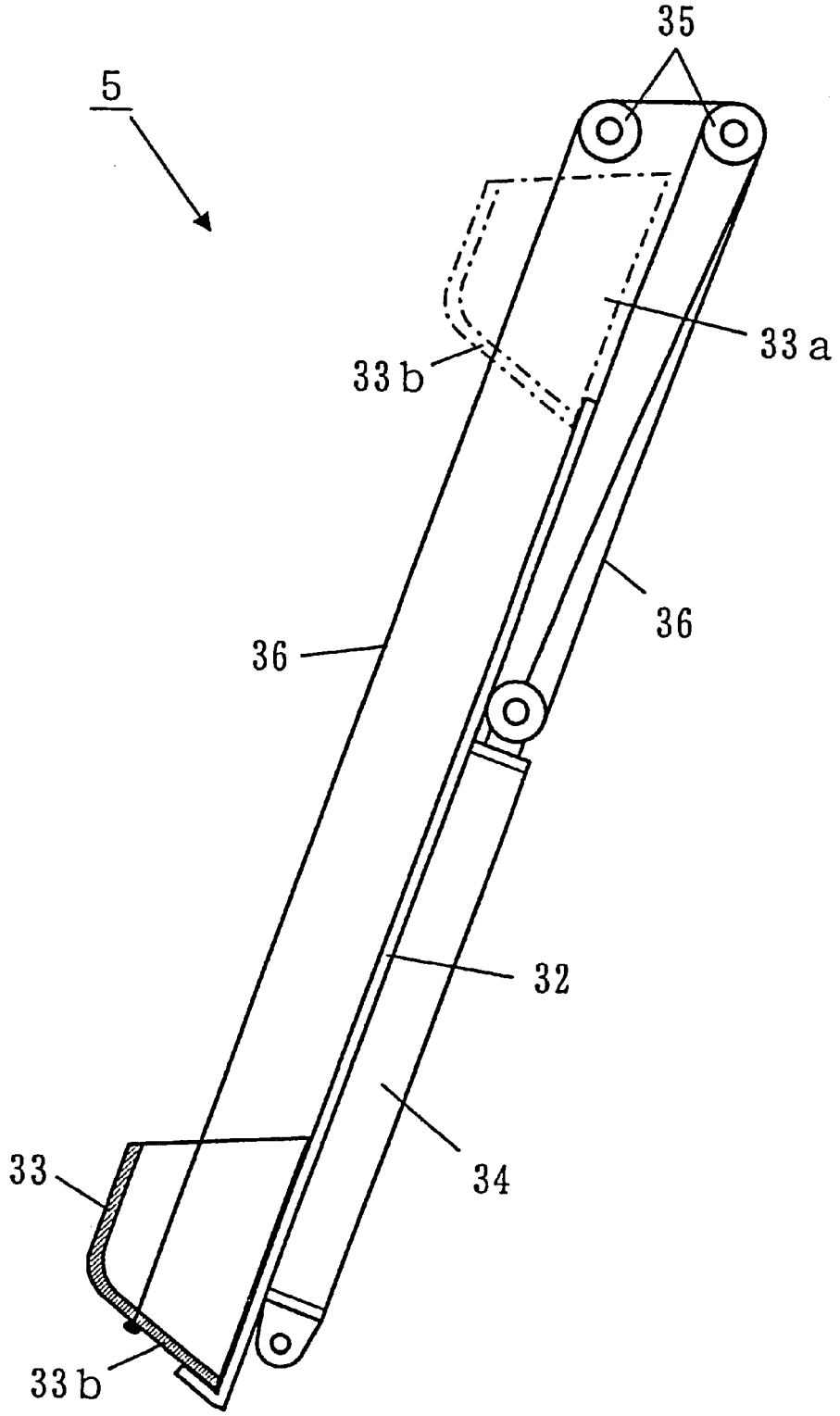
FIG. 5 is a side elevational view of major parts of a charging unit according to the preferred embodiment.

FIG. 5 is a side elevational view showing major parts of the charging unit according to the preferred embodiment.

In the drawing, 32 is an inclination plate, with one end thereof brought into contact with the lower end portion of the crushing chamber charging port 20 of the crushing machine 4, disposed so that the elevation angle with respect to the deck 3 is 45° to 90°, preferably 70° to 90°, in order to make the installation area thereof small and make itself compact. 33 is a charging case which vertically moves along the inclination plate 32 and has a discharge port open to the inclination plate 32 side, wherein 33*a* is a discharge port open to the inclination plate 32 side of the charging case 33, and 33*b* is a bottom plate of the charging case 33. 34 is a charging u nit drive portion consisting of an oil hydraulic cylinder disposed at the crushing machine 4 side of the inclination plate 32. 35 is a block disposed at an appointed position upward of the charging unit drive portion 34. 36 is a wire with one end thereof connected to the bottom plate 33*b* of the charging case 33 and the other end thereof linked to the charging unit drive portion 34 via the block 35.

A description will be given of the actions of the charging unit constructed as described above.

The charging case 33 is moved downward of the charging opening 33*a* of the cover portion 15, solid substances to be crushed are charged into the charging case 33, and the wire 36 is wound by the charging unit drive portion 34, whereby the charging case 33 is moved to the crushing chamber charging port 20 along the inclination plate 32. Solid substances charged into the charging case 33 from the discharge port 33*a* opened at the inclination plate 32 side are discharged when the charging case 33 is moved to the crushing chamber charging port 20 of the crushing machine 4 along the inclination plate 32 and are charged into the crushing chamber 19 of the crushing machine 4.

After the solid substances are charged into the crushing machine 4, the wire 36 is loosened by the charging unit drive portion 34 and the charging case 33 is moved downward of the charging opening 15*a*.

Next, a description will be given of transfer of crushed substances in the preferred embodiment.

An inclination type belt conveyor may be used as a crushed substance transfer device 6. The inclination type belt conveyor is provided with a transfer belt having drop preventing portions erect from appointed positions at both the sides thereof and in the lengthwise direction thereof and has one end disposed downward of the crushing machine 4 and the other end installed at and communicating with the upper end of the screening portion 7.

The crushed substances and cullets crushed and produced by the crushing chamber 19 of the crushing machine 4 fall from the crushed substance collecting portion 24 onto the transfer belt erect from appointed positions of the crushed substance transfer device 6 and surrounded by the drop preventing portions and are transferred to the screening portion 7 installed at and communicating with the other end of the crushed substance transfer device 6 via the porous bottom plate 22.

Next, a description will be given of screening and collection of crushed substances in the preferred embodiment.

The screening portion 7 is composed of crushed substance paths 8*a*, 8*b* and 8*c* branched at and connected to the collecting cases 11*a*, 11*b*, 11*c*, dampers 9*a*, 9*b* and changeover portions 10*a*, 10*b*, which are disposed in the crushed substance paths 8*a*, 8*b* and 8*c*.

In a case of screening crushed substances and cullets, switches are changed over according to the kinds of substances to be charged, such as glass products, chinaware, etc., and colors of glass products when charging solid substances into the charging unit 5, whereby the changeover portions 10*a*, 10*b* are operated to change over the dampers 9*a*, 9*b*, and the collecting position of the cullets and crushed substances is determined to be any one of the collecting cases 11*a*, 11*b* and 11*c*.

The crushed substances and cullets crushed by the crushing machine 4 and transferred to the screening portion 7 by the crushed substance transfer device 6 are collected in any one of the collecting cases 11*a*, 11*b* and 11*c* via any one of the crushed substance paths 8*a*, 8*b* and 8*c* by changing over the dampers 9*a*, 9*b* at the changeover portions 10*a*, 10*b*.

Furthermore, oil hydraulic, electromagnetic, pneumatic types, etc. may be used as changeover portions 10*a*, 10*b* of the dampers 9*a*, 9*b*.

The crushed substances and cullets collected by the collecting cases 11*a*, 11*b* and 11*c* are carried out by opening the top plate portion of the elevating unit 16 having a rail portion on the upper surface of the top plate portion and disposed so as to be openable and closable, drawing the collecting cases 11*a*, 11*b* and 11*c* with the wheels 12, disposed on the bottom face of the collecting cases 11*a*, 11*b* and 11*c*, aligned with the rail 13, placing the collecting cases 11*a*, 11*b* and 11*c* on the rail portion on the upper surface of the top plate portion of the elevating unit 16, and subsequently causing the top plate portion of the elevating unit 16 to be lowered by the elevating and lowering drive means consisting of an oil hydraulic cylinder.

Furthermore, the wheels 12 of the collecting cases 11*a*, 11*b* and 11*c* are placed one after another on the rail portion of the upper surface of the top plate portion of the elevating unit 16, and subsequently the top plate portion of the elevating unit 16 is elevated by the elevation and lowering drive means consisting of an oil hydraulic cylinder, wherein the top plate portion of the elevating unit 16 is aligned with the upper surface of the deck 3, and the collecting cases 11*a*, 11*b* and 11*c* are carried into the deck 3 along the rail 13.

Furthermore, the collecting cases 11*a*, 11*b* and 11*c* are fixed by applying stoppers to the wheels 12 disposed on the bottom surface of the collecting cases 11*a*, 11*b* and 11*c* while the solid substance crushing vehicle 1 is running or during crushing work.

Since a solid substance crushing vehicle according to the preferred embodiment is constructed as described above, the vehicle has the following features.

a. Since a crushing machine, a charging unit, a crushed substance transfer device, a screening portion, collecting cases, and a dust collector are installed on the deck of a vehicle, the entire system is able to move to an incombustible gathering place and any optional place such as islands, sightseeing places, and is able to collect and crush solid substances such as glass products, chinaware, old stools, bricks, refractories, etc. and to produce cullets therefrom.

b. Solid substances can be crushed and cullets can be produced therefrom by only opening the shutter type door portion disposed at the cover portion, charging solid substances in the charging case and switching on the system.

c. Since the charging unit is provided with an inclination plate and a charging case having a discharge port open to the inclination plate side, solid substances can be transferred to the crushing chamber charging port of the crushing machine by only causing the charging case to vertically move along the inclination plate with solid substances charged in the charging case, and they are charged in the crushing chamber. Therefore, solid substances can be automatically charged.

d. Since a crushed substance transfer device is connected downward of the crushing machine, the produced crushing substances and cullets can be automatically transferred to the screening portion. Furthermore, since the transfer belt of the crushed substance transfer device is provided with drop preventing portions, it is possible to securely transfer the crushed substances and cullets to the screening portion without being scattered or falling down in the surroundings.

e. Since the screening portion provided with dampers is connected to the end portion of the crushed substance transfer device and a plurality of collecting cases are provided thereat, the dampers of the screening portion can be changed over according to the kinds and colors of solid substances when solid substances such as glass products, chinaware, old stools, bricks, refractories, tourmaline of magnetic ores, etc. are charged, whereby it is possible to collect the crushed substances and cullets color by color and kind by kind in each of the collecting cases.

f. Since rails are installed on the deck, wheels are disposed on the bottom surface of the collecting cases and roll on the rails, and simultaneously rail portions are provided on the upper surface of the top plate portion, and an elevating unit is disposed at the opening formed at the cover portion at the side of the collecting cases, the collecting cases can be placed on the elevating unit along the rails when carrying out the crushed substances and cullets accumulated in the collecting cases or when carrying in the collecting cases, and it is possible to carry in and out of the collecting cases by vertical movements of the elevating unit.

g. Since the cover portion is disposed upward of the deck and covers the respective devices, it is possible to protect the respective devices and they are not exposed on the deck. It is possible to have safety when operating the respective devices.

h. Since the system is provided with a dust collector connected to the crushing machine and collecting cases, it is possible to prevent dust and dirt from being scattered in the surrounding and possible to prevent the drive means, etc. of the respective devices from malfunctioning due to dust and dirt.

What is claimed is:

1. A solid substance crushing vehicle comprising:

a vehicle;

a crushing machine installed on a deck of said vehicle;

a charging unit for charging solid substances into said crushing machine;

a crushed substance transfer device linked to said crushing machine and used for transferring crushed substances;

a screening portion, linked to said crushed substance transfer device which screens the crushed substances for color and kind;

at least one collecting case disposed at a discharge side of said screening portion;

an elevating unit for elevating and lowering said at least one collecting case;

a cover portion installed upward of said deck for covering said crushing machine said charging unit, said crushed substance transfer device, said screening portion and said at least one collecting case;

a charging opening portion formed at said cover portion in order to charge solid substances; and an opening formed at a side of said at least one collecting case in said cover portion.

2. The solid substance crushing vehicle as set forth in claim 1, wherein said crushing machine comprises:

a cylindrical crushing chamber;

a drive shaft located in a same direction as an axial direction of said crushing chamber disposed at a roughly middle portion of said crushing chamber;

means for driving said crushing machine connected to said drive shaft and disposed on an upper surface of a ceiling portion of said crushing chamber;

a crushed substance collecting portion disposed downward of said crushing chamber;

a porous bottom plate detachably disposed between said crushing chamber and said crushed substance collecting portion and provided with a number of pores;

a rotatable crushing roller connected to said drive shaft via a first means connected to said drive shaft;

a crushing element comprising a number of square columnar rows formed on an outer circumferential face of said crushing roller; and a scraper connected to said drive shaft via a second means connected to said drive shaft.

3. The solid substance crushing vehicle as set forth in claim 2, further comprising:

a dust collecting machine connected to said crushing machine and installed on said deck.

4. The solid substance crushing vehicle as set forth in claim 1, wherein said charging unit comprises:

an inclination plate;

a charging case which vertically moves along said inclination plate;

a discharge port open to an inclination plate side of said charging case; and means for driving the charging unit for vertically moving said charging case.

5. The solid substance crushing vehicle as set forth in claim 4, wherein said charging unit drive means comprises:

a block disposed at an appointed position;

a cylinder for vertically moving said charging case; and a wire for connecting said charging case and said cylinder to each other via said block.

6. The solid substance crushing vehicle as set forth in claim 1, wherein said screening portion comprises:

a crushed substance passage portion installed at and communicating with said crushed substance transfer device;

a damper disposed at said crushed substance passage portion; and means for changing said damper.

7. The solid substance crushing vehicle as set forth in claims 1 or 6, wherein said crushed substance transfer device comprises a belt conveyor which is disposed below said crushing machine and is provided with a transfer belt having a drop preventing portion erect from side portions and at appointed positions in a lengthwise direction thereof.

8. The solid substance crushing vehicle as set forth in claim 1, wherein said elevating unit comprises a lift portion having a rail portion on an upper surface of said deck, at which said deck is disposed so as to be openable and closeable, and means for driving the elevating unit for vertically moving said lift portion.

9. The solid substance crushing vehicle as set forth in claim 1, further comprising:

a rail disposed on said deck downward of said at least one collecting case; and a wheel disposed on a bottom face of said at least one collecting case and rolling on said rail.

10. The solid substance crushing vehicle as set forth in claim 1, wherein at least said crushing machine, said charging unit, said crushed substance transfer device, said screening portion, and said elevating unit, are provided with means for driving said crushing machine, said charging unit, said crushed substance transfer device, said screening portion, and said elevating unit, using an oil hydraulic system.

* * * * *